US005079034A

United States Patent [19]

Miyake et al.

[11] Patent Number: 5,079,034

[45] Date of Patent: Jan. 7, 1992

[54] METHOD FOR MANUFACTURING A WATER ABSORBENT COMPOSITE BY APPLYING AN AQUEOUS POLYMERIZABLE SOLUTION TO A SUBSTRATE AND POLYMERIZING THE COATING AGAINST POLYMERIZATION INNER SURFACES

[75] Inventors: Koji Miyake; Nobuyuki Harada, both of Osaka; Kazumasa Kimura, Nara; Tadao Shimomura, Osaka, all of Japan

[73] Assignee: Nippon Shokubai Kagako Kogyo Co., Ltd., Osaka, Japan

[21] Appl. No.: 437,714

[22] Filed: Nov. 17, 1989

[30] Foreign Application Priority Data

Nov. 21, 1988 [JP] Japan ..... 63-292312
Nov. 21, 1988 [JP] Japan ..... 63-292313

[51] Int. Cl.[5] ..... B05D 3/06

[52] U.S. Cl. ..... 427/45.1; 427/54.1; 427/55; 427/348; 427/371; 427/388.4; 427/434.2

[58] Field of Search ..... 427/434.2, 333, 388.4, 427/370, 54.1, 55, 45.1, 348, 371, 209; 118/106, 117, 125; 526/920, 921, 922; 264/136, 137, 216, 236, 247

[56] References Cited

U.S. PATENT DOCUMENTS 4,294,782 10/1981 Froehlig ..... 264/1.4
4,656,232 4/1987 Nakaki et al. ..... 526/88
4,883,716 11/1989 Effenberger et al. ..... 428/421
4,973,632 11/1970 Nagasuna et al. ..... 526/200

FOREIGN PATENT DOCUMENTS 60-149609 8/1985 Japan .
60-151381 8/1985 Japan .
62-243606 10/1987 Japan .
62-243612 10/1987 Japan .
173706 7/1963 U.S.S.R. .
706474 3/1977 U.S.S.R. .

*Primary Examiner*—Shrive Beck
*Assistant Examiner*—Benjamin L. Utech
*Attorney, Agent, or Firm*—Armstrong, Nikaido, Marmelstein, Kubovcik & Murray

[57] ABSTRACT

A method of preparation of an absorbent composite in which an aqueous solution containing a water-soluble radical polymerization initiator and a water-soluble ethylenically unsaturated monomer which can be converted into an absorbent polymer by polymerization is applied to a substrate, and the monomer is polymerized while the substrate to which the aqueous solution is applied is, on both the sides, held in contact with polymerization-inert surfaces facing each other. A continuous manufacturing method includes the sequential steps of continuously passing a substrate through (1) a region applying to the substrate an aqueous solution containing a water-soluble radical polymerization initiator and a water-soluble ethylenically unsaturated monomer which can be converted into an absorbent polymer by polymerization, and (2) a region of polymerizing the monomer while maintaining the substrate, on both the sides, in contact with polymerization-inert surfaces facing each other.

14 Claims, 3 Drawing Sheets

METHOD FOR MANUFACTURING A WATER ABSORBENT COMPOSITE BY APPLYING AN AQUEOUS POLYMERIZABLE SOLUTION TO A SUBSTRATE AND POLYMERIZING THE COATING AGAINST POLYMERIZATION INNER SURFACES

BACKGROUND OF THE INVENTION

This invention relates to a method for preparation of an absorbent composite having an absorbent polymer firmly fixed to a substrate. More particularly, the invention relates to a method of manufacturing easily and at high productivity an absorbent composite excellent in absorption capacity, outstandingly low in the residual monomer in the absorbent polymer, and superior in safety, in which the absorbent polymer does not drop off the substrate even after absorbing a large quantity of water, a method of manufacturing continuously and at high productivity, a product obtained from these methods, and an apparatus to be used in such methods.

Recently as the means of obtaining absorbent composite by fixing an absorbent polymer to a substrate, various methods of applying a water-soluble monomer which can be converted into an absorbent polymer on a substrate, and then polymerizing have been proposed (for example, the Japanese Official Patent Provisional Publication Nos. 60-149609, 62-243606, 60-151381, and 62-243612). Since the polymerization reaction of water-soluble monomer in such proposed methods is impeded by oxygen and others existing in the air, it is performed in a polymerization-inert atmosphere such as an oven completely replaced by nitrogen gas.

By these known methods, however, when polymerizing the monomer applied on the substrate, it is required to keep the substrate in a specifically determined condition for a long period, and the apparatus for polymerization itself becomes large in size, and the energy loss is significant, and it is not advantageous for manufacturing absorbent composite industrially. Besides, the absorption capacity of the obtained absorbent composite was insufficient, and the amount of the residual monomer was too much.

OBJECTS OF THE INVENTION

This invention is intended to solve the above problems for industrially manufacturing absorbent composites.

It is hence a primary object of the invention to present a method of easily and efficiently manufacturing an absorbent composite having an absorbent polymer firmly fixed to a substrate, exhibiting an excellent absorption capacity without the polymer dropping off the substrate even after swelling of the polymer, and very low in the residual monomer in the absorbent polymer.

It is other object of the invention to present a method of manufacturing such absorbent composite easily, efficiently, and continuously.

It is a different object of the invention to present an absorbent composite preferably used as sanitary material such as disposable diapers produced in such manufacturing methods.

It is a further different object of the invention to present a manufacturing apparatus to be used in the continuous manufacturing method.

SUMMARY OF THE INVENTION

This invention relates to a method of preparation of an absorbent composite in which an aqueous solution containing a water-soluble radical polymerization initiator and a water-soluble ethylenically unsaturated monomer which can be converted into an absorbent polymer by polymerization is applied to a substrate, and the monomer is polymerized while the substrate to which the aqueous solution is applied is, on both the sides, held in contact with polymerization-inert surfaces facing each other.

The invention also relates to a continuous manufacturing method of an absorbent composite characterized by continuously passing in the sequence of 1. the region of applying to a substrate an aqueous solution containing a water-soluble radical polymerization initiator and a water-soluble ethylenically unsaturated monomer which can be converted into an absorbent polymer by polymerization, and 2. the region of polymerizing the monomer in the state of holding the substrate, on both the sides, in contact with polymerization-inert surfaces facing each other, while moving the substrate.

The invention further relates to a manufacturing apparatus of an absorbent composite comprising the following means 1 and 2 arranged along the moving route of the substrate for applying to the substrate, while moving the substrate continuously, an aqueous solution containing a water-soluble radical polymerization initiator and a water-soluble ethylenically unsaturated monomer which can be converted into an absorbent polymer by polymerization, polymerizing the monomer under a condition that the substrate is, on both the sides, held in contact with polymerization-inert surfaces facing each other, and thereby fixing the absorbent polymer to the substrate.

(1) Means for applying to a moving substrate an aqueous solution containing a water-soluble radical polymerization initiator and a water-soluble ethylenically unsaturated monomer which can be converted into an absorbent polymer by polymerization.

(2) Polymerization means possessing facing polymerization-inert surfaces and means for setting a gap of a clearance corresponding to the thickness of the substrate between the facing polymerization-inert surfaces, for polymerizing the monomer while the substrate to which the aqueous solution is applied is passing through the gap to fix the absorbent polymer to the substrate.

The substrate to be used in the present invention is not particularly limited as far as it is wanted to have an absorption property, and a proper one may be selected from various materials depending on the application of the obtained absorbent composite. Practical examples may include sponge and spongy porous substrates such as synthetic resin foam, and fibrous substrates of paper, string, non-woven fabric, woven fabric and the like made of synthetic fibers such as polyester and polyolefin, cellulose fibers such as cotton and pulp, and others. As a substrate of a long size used in the continuous manufacturing method, it is not particularly limited as far as the length is sufficient for continuously passing the polymerization region and drying region mentioned later, and a proper one may be selected from various materials depending on the application of the obtained absorbent composite (for example, as listed above). Or, in the continuous manufacturing method, instead of the substrate of a long size, a substrate of a short size or substrates of various lengths may be also used. For example, when the substrate is moved by putting on a substrate moving table such as belt and tray, it may be applied also in the continuous manufacturing method. In this case, when the face of the substrate moving table contacting with the substrate is a polymerization-inert surface, it is convenient for polymerization.

As the water-soluble ethylenically unsaturated monomer used in the invention, it is not particularly limited as far as it can be converted into an absorbent polymer by polymerization, and practical examples may include unsaturated monomers containing carboxyl group such as acrylic acid, methacrylic acid, crotonic acid, itaconic acid, maleic acid, fumaric acid, citraconic acid, other unsaturated carboxylic acids, and their lithium, sodium, potassium and other alkaline metal salts, ammonium salt and organic substitutional ammonium salts; unsaturated monomers containing sulfonic group such as 2-(meth)acryloylethane sulfonic acid, 2-(meth)acryloylpropane sulfonic acid, (meth)acryloylpropane-2-sufonic acid, 3-(meth)acryloylpropane sulfonic acid, 2-(meth)acryloylbutane sulfonic acid, (meth)acryloylbutane-2-sulfonic acid, 4-(meth)acryloylbutane sulfonic acid, 2-(meth)acrylamido-2-methylpropane sulfonic acid, 2-(meth)acrylamidoethane sulfonic acid, 3-(meth)acrylamidopropane sulfonic acid, 4-(meth)acrylamidobutane sulfonic acid, vinyl sulfonic acid, (meth)allylsulfonic acid, other unsaturated sulfonic acids, and their alkaline metal salts, calcium, magnesium, other alkaline earth metal salts, ammonium salt, and organic substitutional ammonium salts, water-soluble unsaturated monomers such as (meth)acrylamide, (meth)acrylonitrile, vinyl acetate, N,N-dimethylaminoethyl (meth)acrylate, and its quartenary compounds and others; and (meth)acrylic acid esters such as hydroxyethyl(meth)acrylate, hydroxypropyl-(meth)acrylate, polyethylene glycolmono(meth)acrylate, polypropylene glycolmono(meth)acrylate, methoxypolyethylene glycolmono(meth)acrylate, methoxypolypropylene glycolmono(meth)acrylate, methoxypolybutylene glycolmono(meth)acrylate, ethoxypolyethylene glycolmono(meth)acrylate, ethoxypolypropylene glycolmono (meth)acrylate, ethoxypolybutyrene glycolmono(meth)acrylate, methoxypolyethylene glycol-polypropylene glycolmono(meth)acrylate, phenoxypolyethylene glycolmono (meth)acrylate, benzyloxypolyethylene glycolmono(meth)acrylate, methyl(meth)acrylate, ethyl(meth)acrylate, and butyl(meth)acrylate, and one or more types thereof may be used. Among them, preferably, a desired material is at least one monomer selected from a group comprising (meth)acrylic acid and its salt, 2-(meth)acryloylethane sulfonic acid and its salts, 2-(meth)acrylamido-2-methylpropane sulfonic acid and its salt, and (meth)acrylamide. More preferably, (meth)acrylic acid and/or its salt is the principal ingredient of the water-soluble ethylenically unsaturated monomer. In this case, considering the reactivity of monomer and absorption characteristic of the obtained absorbent composite, the content of (meth)acrylic acid and its salt is preferably in a range of 50 to 100 mol % of the entire water-soluble ethylenically unsaturated monomer.

The monomer concentration in aqueous solution is not particularly defined, but it is desired to be in a range from 20 wt. % to saturated concentration, considering the labor in drying procedure of the obtained absorbent composite, or more preferably from 30 to 70 wt. %.

As the water-soluble radical polymerization initiator used in this invention, hitherto known compounds may be listed, for example, persulfates such as potassium persulfate, sodium persulfate, and ammonium persulfate; peroxides such as hydrogen peroxide, and t-butyl hydroperoxide; and azo compounds such as 2,2'-azobis(2-amidinopropane)dihydrochloride, and 2,2'-azobis(N,N'-dimethylene isobutylamidine)dihydrochloride. Though each of these polymerization initiators may be solely used, two or more types of them may be also used by mixing, or they may be used as redox initiators by combining with reducing agents such as sulfites, L-ascorbic acid, and ferrous chloride.

In this invention, in addition to the water-soluble ethylenically unsaturated monomer, it is desired to contain a crosslinking agent in the aqueous solution to be applied to the substrate. Practical examples of crosslinking agent may include, for example, compounds (a) possessing two or more ethylenically unsaturated groups in one molecule, and/or compounds (b) possessing two or more groups reacting with functional groups such as carboxylic group and sulfonic group in the water-soluble ethylenically unsaturated monomer. Practical examples of said compounds (a) may include, for example, ethyleneglycoldi(meth)acrylate, diethyleneglycoldi(meth)acrylate, triethyleneglycoldi(meth)acrylate, trimethylolpropanetri(meth)acrylate, pentaerythritoltri(meth)acrylate, pentaerythritoldi(meth)acrylate, N,N'-methylenebis(meth)acrylamide, triallyl isocyanurate, and trimethylolpropane diallylether. Practical examples of said compounds (b) may include, for example, polyhydric alcohols such as ethylene glycol, diethylene glycol, triethylene glycol, polyethylene glycol, glycerin, polyglycerin, propylene glycol, diethanolamine, triethanolamine, polypropylene glycol, polyvinyl alcohol, pentaerythritol, sorbit, sorbitan, glucose, mannit, mannitan, and sucrose; polyepoxy compounds such as ethylene glycol diglycidylether, glycerin diglycidylether, polyethylene glycol diglycidylether, propylene glycol diglycidylether, polypropylene glycol diglycidylether, neopentyl glycol diglycidylether, 1,6-hexane glycol diglycidylether, trimethylol propane diglycidylether, trimethylol propane triglycidylether, and glycerin triglycidylether; and polyamine compounds such as ethylene diamine and polyethyleneimine. One or more types of each of said compounds (a) and (b) may be used.

When a polyhydric alcohol is used as the crosslinking agent, it is desired to keep the ambient temperature after polymerization (the ambient temperature in the drying region in the continuous manufacturing method) in a range of 150° to 250° C., for heat treatment of the absorbent composite, and when a polyepoxy compound is used, it is desired to keep in a range of 50° to 250° C.

Use of a crosslinking agent is desired in that the ratio of absorption of the obtained absorbent composite may be easily controlled. The crosslinking agent may be used not only by contained in the aqueous solution to be applied on the substrate, but also by sprinkled over the substrate after polymerization (for example, the substrate in the process of passing through the drying region) to realize secondary crosslinking of the formed absorbent polymer.

The content of the water-soluble radical polymerization initiator in the water-soluble ethylenically unsaturated monomer is not particularly defined, but it is desired to add the initiator by 0.01 to 5 parts (by weight) to 100 parts of monomer. If the content of the initiator is less than 0.01 part, the polymerization of monomer may not be complete, and if the content is larger than 5 parts, the absorption capacity of the absorbent polymer formed by polymerization may be lowered. The content of the crosslinking agent, if used, is not particularly limited, but it is desired to use the crosslinking agent by 0.005 to 5 parts (by weight) to 100 parts of monomer. If the crosslinking agent is added excessively or insufficiently, the absorption capacity of the absorbent polymer produced by polymerization may be lowered.

Methods for applying an aqueous solution containing the water-soluble ethylenically unsaturated monomer and water-soluble radical polymerization initiator (hereinafter sometimes called aqueous monomer solution) to the substrate may include the coating by known printing or textile printing methods such as spraying, brushing, roller coating and screen printing, and impregnation of the substrate with the aqueous solution followed by squeezing off to a specified amount. The means for such application of the aqueous solution is disposed in the applying region. Though the amount of the aqueous monomer solution to be deposited on the substrate is not particularly limited, it is generally in the range of 0.1 to 100 parts by weight, preferably 0.5 to 20 parts by weight, based on 1 part by weight of the substrate. The mode of deposition of aqueous monomer solution may be either uniform on the entire surface of the substrate, or non-uniform, such as stripe, lattice, dot and other patterns.

When applying the aqueous monomer solution to the substrate, in order to enhance the absorption capacity of the obtained absorbent composite as well as the efficiency of deposition, thickener and other additives may be contained in the aqueous monomer solution. Such additives may include, for example, polyacrylic acid (or its salt), polyvinyl pyrrolidone, hydroxyethyl cellulose, and pulp fibers.

In this invention it is essential to perform polymerization reaction while holding the substrate, to which the aqueous monomer solution is applied, on both the sides, in contact with polymerization-inert surfaces facing each other. By polymerization or as required afterwards, the substrate after polymerization is dried, and the absorbent composite of the present invention is obtained. In the case of continuous manufacturing method, practically, the substrate to which the aqueous monomer solution is applied is led into the polymerization region comprising an apparatus possessing polymerization-inert surfaces for holding the substrate, and is passed between the facing polymerization-inert surfaces to obtain the absorbent composite by polymerization, or after polymerization, the substrate may be continuously passed in the drying region comprising an apparatus for heating the substrate, while holding the substrate in a gas in succession.

The polymerization-inert surfaces may be any surfaces that would not allow to pass oxygen and others which may impede the polymerization of water-soluble monomer, which may include, for example, glass fiber and other ceramics, steel and other metals, fluororesin, silicone resin, polyester resin and other plastics, being manufactured in the forms of belt, roll, film, sheet, plate, etc. These surfaces are preferably finished in mirror-smooth surface or treated with fluororesin in order to prevent sticking of the absorbent polymer produced in the polymerization process.

The distance (clearance) of the facing polymerization-inert surfaces may be set, for example, to be equivalent to the thickness of the substrate in a stationary state, or the thickness measured in pressure-free state. A proper clearance may be adjusted by placing an adjuster (such as a screw) between the support members for supporting the facing polymerization-inert surfaces, and moving one of the surfaces closer to or remoter from the other by turning the screw. In this case, it is convenient for handling substrates of different thickness. Or when a press plate is used, a spacer having proper thickness (for example, equivalent to thickness of the substrate) may be placed between the two surfaces.

Moreover, in order to promote the polymerization to a high degree of polymerization without delay followed by obtaining an absorbent composite excellent in absorption capacity, it is desired to heat the substrate held by the facing polymerization-inert surfaces during polymerization. Specifically, the substrate may be heated in contact by surfaces of facing belts or the like set to a desired temperature by an electric heater, steam or the like, in the held state, during polymerization, the substrate held between surfaces of facing belts is indirectly heated by microwaves, or the substrate may be held by heated press plates.

The temperature of the substrate upon start of polymerization may differ depending on the type and quantity of radical polymerization initiator, or type and concentration of monomer, but it is generally preferable to keep the decomposition temperature or more of the radical polymerization initiator. Practically, in the case of contact heating, the temperature of the surfaces for holding the substrate may be preferably kept at 50° to 150° C., or more preferably 100° to 120° C. If the temperature is less than 50° C., it is difficult to promote the polymerization promptly to a high degree of polymerization, and if higher than 150° C., the substrate may deteriorate, or the polymerization may be promoted abruptly, making it difficult to control the polymerization, which is not desired. Besides, once the polymerization is started, since heat is generated, it is desired to control the polymerization by adjusting the temperature of surfaces holding the substrate.

Furthermore, in order to promote the polymerization smoothly to a high degree of polymerization, it is desired to keep the surroundings of the facing polymerization-inert surfaces in a polymerization-inert gas atmosphere such as nitrogen.

The time for performing polymerization is not particularly defined, but it is generally 1 to 10 minutes in contact heated polymerization, 10 to 60 seconds in indirectly heated polymerization. In the case of continuous manufacturing method, the substrate may be passed through the facing polymerization-inert surfaces by taking such time as mentioned above.

In this invention, the polymerization may be directly controlled through surfaces holding the substrate, and since the substrate is held by facing surfaces, the effects of fluctuation of monomer concentration due to evaporation of water and oxygen and others which may impede polymerization may be eliminated, and hence the absorbent composite excellent in absorption capacity and far less in the residual monomer may be manufactured easily and at high productivity.

Thus, when the monomer applied to the substrate is polymerized under a condition that the substrate to which the aqueous monomer solution is applied is held by facing polymerization-inert surfaces, an absorbent composite having the water-containing gel of the absorbent polymer formed by polymerization firmly fixed to the substrate will be obtained. However, depending on the monomer concentration of aqueous monomer solution being used, a certain tackiness may be caused in the obtained absorbent composite, and it may be inferior in handling, and therefore it is desired to dry the absorbent composite as required after polymerization.

Any drying method may be applicable, such as the means for hot air, microwaves, infrared rays, and ultraviolet rays.

In the continuous manufacturing method, too, the substrate passing through the polymerization region is sequentially led into the drying region, if drying is necessary, where the substrate is dried, and a desired absorbent composite is obtained.

The drying region in this invention comprises an apparatus for heating the substrate while holding the substrate in a gas, and the examples of a gas may include the air, an inert gas such as nitrogen, steam-air mixture, steam-inert gas mixture, and steam, and the apparatus for holding the substrate in the gas atmosphere may be, for example, rotatable support rolls and support belts, and examples of heating apparatus may include heater with fan for generating hot gas, and machines generating microwaves, infrared rays, ultraviolet rays, and others.

The substrate heating temperature in the drying region may be properly set in consideration of the drying efficiency, and it is desired to keep under 250° C. in order to prevent deterioration of absorbent polymer. Or, from the viewpoint of absorption capacity of the obtained absorbent composite, it is desired to heat 80° C. or more.

The substrate retention time in the drying region is arbitrary, and basically the substrate is kept within the drying region until the tackiness is eliminated from the obtained absorbent composite. Or, by pressure-bonding and drying other substrate to the absorbent composite before the tackiness is eliminated, the absorbent composite and other substrate may be glued together.

In the case of continuous manufacturing method, the substrate moving speed may be set properly depending on the time required for polymerization or drying in the polymerization region or drying region, and the area of these regions, and it is not particularly defined. From the viewpoint of industrial productivity, the moving speed of the substrate is preferably 0.1 to 100 m/min.

Besides, in the drying region, in order to partially change the absorption capacity of the obtained absorbent composite, a compound possessing two or more functional groups capable of reaction with functional group, such as carboxyl group and sulfonic group, for example, polyvalent metal salts and polyethylene glycol diglycidylether may be partly applied to the substrate.

According to the method of the present invention, the absorbent composite having the absorbent polymer firmly fixed to the substrate may be easily and efficiently manufactured using simple equipment.

According to the apparatus of the present invention, a clearance between facing polymerization-inert surfaces may be easily set and such continuous method may be executed.

Besides, the absorbent composite manufactured by the method of the present invention is excellent in absorption capacity, and is outstandingly low in the residual monomer content in the polymer, and therefore it is free from adverse effects on the human health or environments, and it may be hence used widely in sanitary materials, foods, civil engineering, building materials, electric power, agriculture and other fields where absorption and water retaining properties are required.

DETAILED DESCRIPTION OF THE INVENTION

Figure 1:
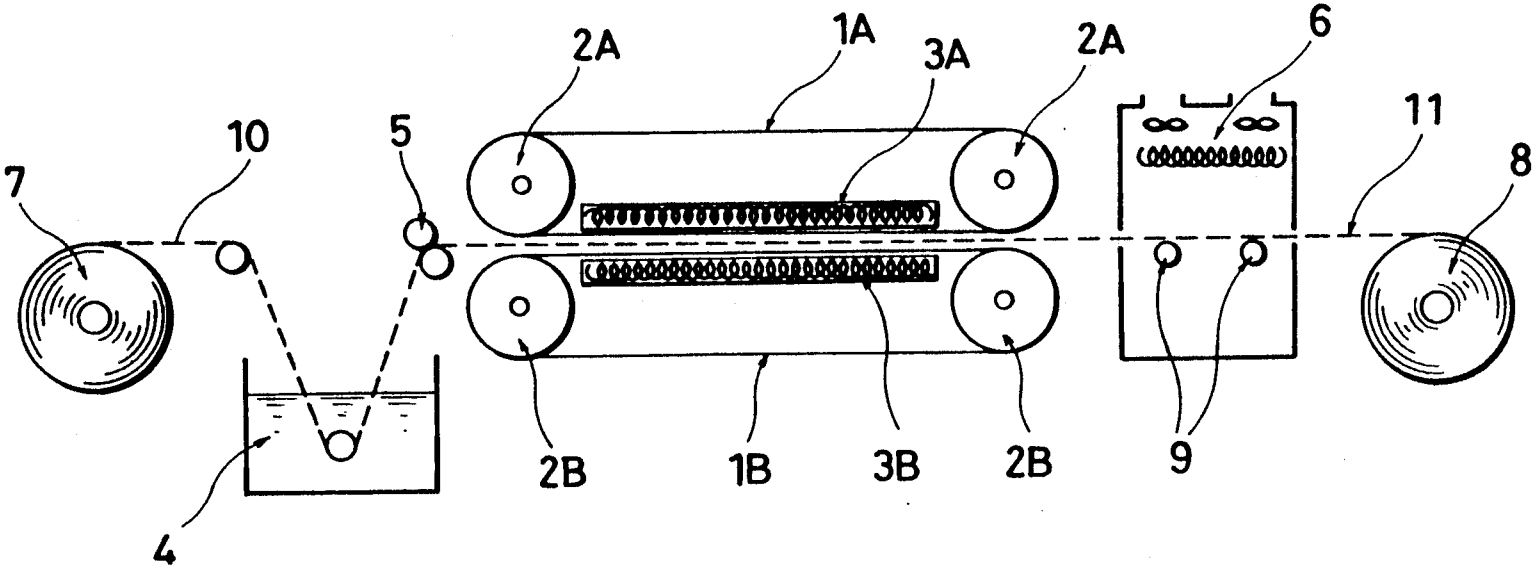
FIG. 1 is a schematic diagram for showing a first embodiment of the apparatus for executing the continuous manufacturing method of the invention.
Figure 2:
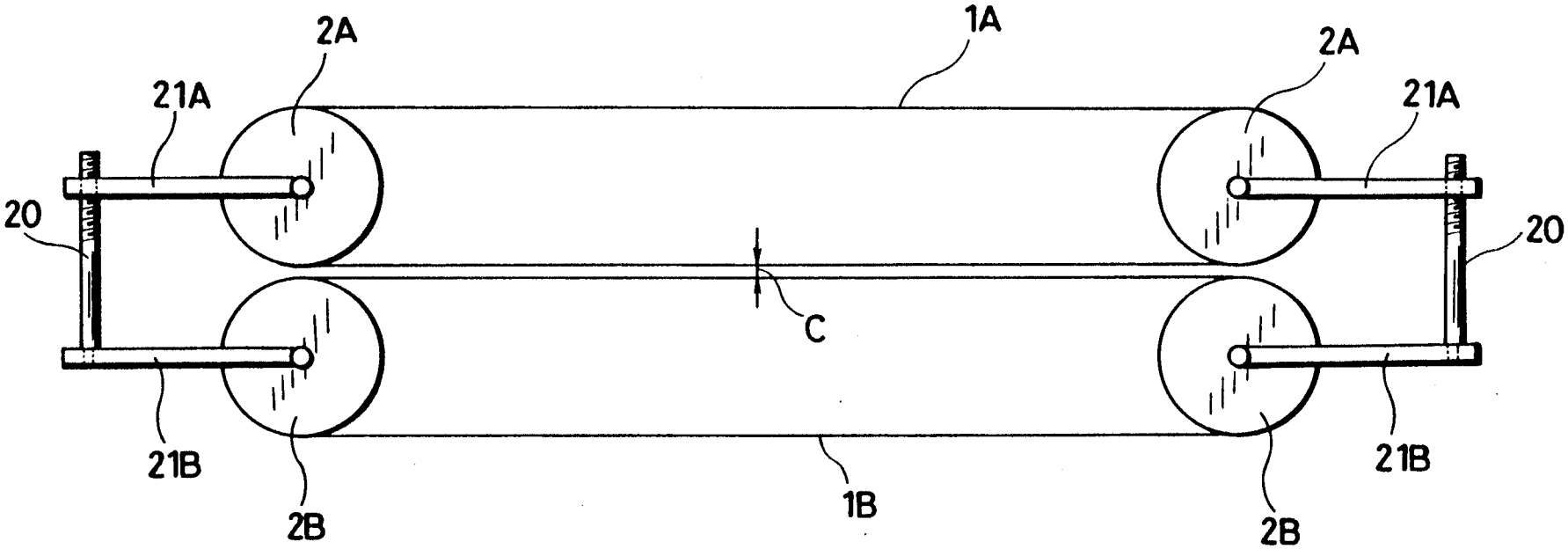
FIG. 2 is a schematic diagram for explaining a part thereof.

Referring now to the drawings, the continuous manufacturing method of the present invention is described below. FIG. 1 is a schematic diagram showing an example of the apparatus for executing the continuous manufacturing method of the invention, FIG. 2 is a schematic explanatory drawing magnifying a part thereof, and FIG. 3 is a schematic diagram showing other example of the apparatus.

In the apparatus shown in FIG. 1, the polymerization region is composed of endless belts 1A and 1B for holding a substrate 10 on both the sides, and steam heaters 3A and 3B are disposed in the vicinity of the contacting surfaces of the endless belts 1A and 1B with the substrate 10 for heating the substrate 10. Besides, in the apparatus shown in FIG. 1, the drying region comprising a hot air dryer 6, and the substrate 10 is held in the atmosphere of the circulating hot air by means of a support roll 9.

Figure 3:
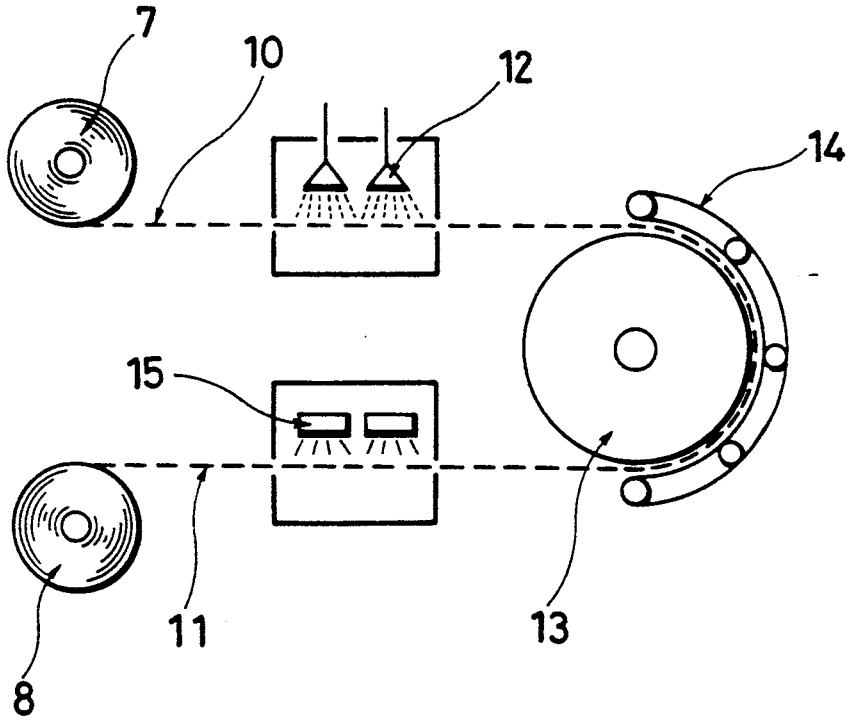
FIG. 3 is a schematic diagram for explaining other embodiment of the apparatus for executing the continuous manufacturing method of the invention.

On the other hand, in the apparatus shown in FIG. 3, the polymerization region is composed of a drum roll 13 and an endless belt 14 which is disposed so as to cover part of the circumference of the drum roll 13, and the substrate 10 is held between the circumferential surface of the drum roll 13 and the surface of endless belt 14. Moreover, in the apparatus shown in FIG. 3, the drying region comprises a compartment for heating the substrate 10 with infrared irradiation from an infrared lamp 15.

A substrate of a long size 10 is let off from the let-off roll 7, and is continuously taken up on a take-up roll 8 after passing through the polymerization region and drying region, and the take-up roll 8 is rotated and driven in the winding direction of the substrate 10.

In the apparatus shown in FIG. 1, the substrate 10 is first immersed in an aqueous monomer solution 4, and the excess aqueous monomer solution is squeezed off by a squeeze roll 5.

The substrate 10 thus applied with the aqueous monomer solution is subjected to monomer polymerization in a state that the substrate is, on both the sides, held in contact with facing surfaces of the endless belts 1A and 1B.

The clearance C between the facing surfaces of the endless belts 1A and 1B is set, for example, by a clearance adjuster 20 shown in FIG. 2. The clearance adjuster 20 is placed between the support member 21A and 21B of the belt drive rolls 2A and 2B. The support member 21A is fitted at both ends of the two belt drive rolls 2A, and the support member 21B is fitted at both ends of the two belt drive rolls 2B. The clearance adjuster 20 is driven in the mutually opposing winding threads to the support members 21A and 21B. When the clearance adjuster 20 is turned in one direction (for example, clockwise), the support members 21A and 21B approach to each other, and the clearance C is narrowed, and when turned in the other direction (for example, counterclockwise), the support members 21A and 21B become remote from each other, so that the clearance C is widened. The clearance C is adjusted in this way, for example, so as to be equivalent to the thickness of the substrate 10.

The endless belts 1A and 1B are driven in the moving direction of the substrate 10 by the belt drive rolls 2A and 2B, respectively, and the peripheral speed of the endless belts 1A and 1B is preferably tuned with the peripheral speed of the take-up roll 8. In the vicinity of the contacting surface of the endless belts 1A and 1B with the substrate 10, steam heaters 3A and 3B are disposed for promoting the polymerization reaction, so that the substrate 10 is heated.

The substrate passing through the polymerization region is led into the hot air drier 6. In the drier 6 in which hot air is circulating, the substrate is dried as being held in the air by the support roll 9.

When dried until the tackiness is eliminated from the substrate in the drying region, the substrate leaves the drier 6, and is taken up on the take-up roll 8, so that a product of absorbent composite 11 is obtained.

In the apparatus shown in FIG. 3, in order to apply the aqueous monomer solution onto the substrate, the aqueous monomer solution is sprayed onto the substrate 10 from a spray nozzle 12. The substrate 10 first passes through the polymerization region under a condition that the substrate is, on both the sides, held in contact with the circumferential surface of the heated drum roll 13 and the surface of endless belt 14, and the monomer is polymerized. Next, the substrate 10 passes near the infrared lamp 15, and is heated and dried by the infrared rays emitted from the lamp 15, thereby becoming an absorbent composite 11.

The present invention is further described below while referring to embodiments, but it must be noted that the scope of the invention is not limited to the illustrated embodiments alone. Meanwhile, the absorption performance of the absorbent composite (ratio of absorption), the amount of the residual monomer in the absorbent polymer in the absorbent composite, and the drop-off rate of absorbent polymer mentioned in the embodiments were measured in the following testing methods.

(1) Ratio of Absorption

A bag (40 mm × 150 mm) made of non-woven fabric after the fashion of a tea bag and containing a given absorbent composite, 0.5 g in weight, in a finely cut form was immersed in an aqueous solution of 0.9% by weight of sodium chloride for 30 minutes. Then, the bag was pulled out of the aqueous solution, drained for 5 minutes, and weighed. The ratio of absorption of the absorbent composite was calculated in accordance with the following formula.

$$\text{Ratio of absorption (g/g)} = \frac{\text{(Weight of bag after absorption)} - \text{(Weight of blank bag after absorption)}}{\text{Weight of absorbent composite}}.$$

(2) Amount of Residual Monomer

A given absorbent composite was weighed out in an amount containing 0.5 gr. of solids of absorbent polymer, finely cut, and dispersed by stirring in 1 liter of purified water. The resultant dispersion was left standing for two hours and then passed through a glass microfibre filter paper (produced by Whatman Paper Ltd. and marketed under trademark designation of "Whatman filter paper"). The filtrate was tested by high-performance liquid chromatography (HPLC) for residual monomer content. The amount of the residual monomer in the absorbent polymer was calculated from the result of the test.

(3) Drop-off Rate of Absorbent Polymer

A test piece of 5×5 cm was immersed in an excess 0.9 wt. % saline solution for 1 hour, and the swollen test piece was pulled up, and the remaining brine was filtered by a 100-mesh wire net.

The polymer on the wire net was dried in hot air for 1 hour at 120° C., and weighed, and the lost polymer amount was determined, and the polymer drop-off rate was determined in the following equation.

Meanwhile, the test piece was preliminarily dried at 120° C. for 1 hour, and the weight of the absorbent composite was obtained.

$$\text{Drop-off rate (\%)} = \frac{\text{Lost weight of polymer}}{\text{Weight of absorbent composite} - \text{weight of substrate}} \times 100$$

EMBODIMENT 1

To 100 parts by weight of partially neutralized acrylic acid aqueous solution (monomer concentration 40 wt. %) with 75 mol% neutralized by sodium hydroxide, 0.2 part by weight of 2,2'-azobis(N,N'-dimethyleneisobutyl-amidine)dihydrochloride and 0.005 part by weight of N,N'-methylenebisacrylamide were dissolved, and dissolved oxygen in the aqueous monomer solution was removed by nitrogen gas.

This aqueous monomer solution was screen-printed on a polypropylene nonwoven fabric having 30 g/m$^2$ of basis weight, and the deposition of aqueous monomer solution was set at 250 g/m$^2$.

This nonwoven fabric applied with aqueous monomer solution was, on both the sides, held for 5 minutes in contact with two facing mirror-finished steel press plates heated to 60° C. through a spacer in the same thickness as the thickness of the nonwoven fabric in a stationary state, and the monomer was polymerized.

The nonwoven fabric after polymerization was taken out from the press plates, and dried for 5 minutes in a hot air dryer at 120° C., and an absorbent composite (1) was obtained.

The results of evaluation of performance of the obtained absorbent composite (1) are shown in Table 1.

EMBODIMENT 2

The same aqueous monomer solution as used in Embodiment 1 was screen-printed on a polyester nonwoven fabric having 45 g/m$^2$ of basis weight, and the deposition of the aqueous monomer solution was adjusted to 250 g/m$^2$.

This nonwoven fabric applied with aqueous monomer solution was, on both the sides, held for 5 minutes in contact with a pair of facing fluororesin-treated glass fiber endless belts heated to 60° C., and the monomer was polymerized. At this time, the belt interval was set at the same spacing as the thickness of the nonwoven fabric in a stationary state by means of adjuster.

The nonwoven fabric after polymerization was taken out from the belt surfaces, and was dried for 5 minutes in a hot air dryer at 120° C., and an absorbent composite (2) was obtained.

The results of evaluation of performance of the obtained absorbent composite (2) are shown in Table 1.

EMBODIMENT 3

The same aqueous monomer solution as used in Embodiment 1 was sprayed on a polypropylene nonwoven fabric having 30 g/m$^2$ of basis weight by a spray nozzle, and the deposition of the aqueous monomer solution was 300 g/m$^2$.

This nonwoven fabric applied with the aqueous monomer solution was, on both the sides, held in contact with a pair of facing fluororesin-treated glass fiber endless belts, and the monomer was polymerized by emitting microwaves of 2,450 MHz to the nonwoven fabric for 30 seconds at an output of 400 W at ambient temperature of 25° C. At this time, the belt interval was set so as to be equal to the thickness of the nonwoven fabric in a stationary state by means of an adjuster.

The nonwoven fabric after polymerization was taken out from the belt surfaces, and was dried for 5 minutes in a hot air dryer at 120° C., and an absorbent composite (3) was obtained.

The results of evaluation of performance of the obtained absorbent composite (3) are shown in Table 1.

EMBODIMENT 4

To 100 parts by weight of partially neutralized acrylic acid aqueous solution (monomer concentration 60 wt. %) having 75 mol % neutralized by potassium hydroxide, 0.2 part by weight of potassium persulfate and 0.005 part by weight of N,N'-methylene bisacrylamide were dissolved, and the dissolved oxygen in the aqueous monomer solution was removed by nitrogen gas.

This aqueous monomer solution was screen-printed on a polyethylene nonwoven fabric having 30 g/m$^2$ of basis weight, and the deposition of the aqueous monomer solution was set at 400 g/m$^2$.

This nonwoven fabric applied with aqueous monomer solution was held for 5 minutes between two steel press plates heated to 80° C. through a spacer in the same thickness as the thickness of the nonwoven fabric in a stationary state, and the monomer was polymerized.

The nonwoven fabric after polymerization was taken out from the press plates, and was dried for 5 minutes in a hot air dryer at 120° C., and an absorbent composite (4) was obtained.

The results of evaluation of performance of the obtained absorbent composite (4) are shown in Table 1.

EMBODIMENT 5

The same aqueous monomer solution as used in Embodiment 4 was gravure-printed in dot pattern on a hydrophilic pulp mat having 45 g/m$^2$ of basis weight, and the deposition of the aqueous monomer solution was 400 g/m$^2$.

This pulp mat applied with aqueous monomer solution was held between a pair of facing fluororesin-treated glass fiber endless belts, and microwaves of 2,450 MHz was emitted to the pulp mat for 30 seconds at an output of 400 W at ambient temperature of 25° C., and the monomer was polymerized. At this time, the belt interval was set so as to be equal to the thickness of the pulp mat in a stationary state by means of an adjuster.

The pulp mat after polymerization was taken out from the belt surfaces, and was dried for 5 minutes in a hot air dryer at 120° C., and an absorbent composite (5) was obtained.

The results of evaluation of performance of the obtained absorbent composite (5) are shown in Table 1.

EMBODIMENT 6

To 100 parts by weight of 50 wt. % aqueous monomer solution comprising 20 mol % of acrylic acid, 60 mol % of potassium acrylate and 20 mol % of 2-methacryloylethane sulfonic acid potassium salt, 0.5 part by weight of potassium persulfate, 0.003 part by weight of ethyleneglycol diacrylate, and 0.1 part by weight of hydroxyethylcellulose were dissolved, and the dissolved oxygen in the aqueous monomer solution was removed by nitrogen gas.

In this aqueous monomer solution, a polypropylene nonwoven fabric having 30 g/m$^2$ of basis weight was dipped, and the nonwoven fabric entirely impregnated with aqueous monomer solution was squeezed until the deposition of aqueous monomer solution became 150 g/m$^2$.

This nonwoven fabric applied with aqueous monomer solution was held for 5 minutes between two steel press plates heated to 80° C. through a spacer in the same thickness as the thickness of the nonwoven fabric in a stationary state, and the monomer was polymerized.

The nonwoven fabric after polymerization was taken out from the press plates, and was dried by emitting microwaves with an output of 600 W for 30 seconds at frequency of 2,450 MHz, and an absorbent composite (6) was obtained.

The results of evaluation of performance of the obtained absorbent composite (6) are shown in Table 1.

EMBODIMENT 7

To 100 parts by weight of 40 wt. % aqueous monomer solution comprising 15 mol % of methacrylic acid, 45 mol % of sodium methacrylate, 20 mol % of 2-acrylamide-2-methylpropane sulfonic acid sodium salt and 20 mol % of acrylamide, 0.2 part by weight of ammonium persulfate and 0.005 part by weight of trimethylol propane triacrylate were dissolved, and the dissolved oxygen in the aqueous monomer solution was removed by nitrogen gas.

This aqueous monomer solution was screen-printed on a nonwoven fabric consisting of a conjugated polyethylene-polypropylene fiber and having 40 g/m$^2$ of basis weight, and the deposition of aqueous monomer solution was set at 200 g/m$^2$.

This nonwoven fabric applied with aqueous monomer solution was held for 5 minutes between a pair of facing mirror-finished endless steel belts heated to 80° C., and the monomer was polymerized. At this time, the belt interval was set so as to be equal to the thickness of the nonwoven fabric in a stationary state by means of an adjuster.

The nonwoven fabric after polymerization was taken out from the belt surfaces, and was dried for 5 minutes in a hot air dryer at 120° C., and an absorbent composite (7) was obtained.

The results of evaluation of performance of the obtained absorbent composite (7) are shown in Table 1.

REFERENCE 1

A reference absorbent composite (1) was obtained in the same manner as in Embodiment 1, except that the monomer was polymerized for 20 minutes by putting the nonwoven fabric on a steel plate heated to 60° C. in a nitrogen atmosphere, instead of polymerizing by placing the nonwoven fabric applied with aqueous monomer solution between two steel press plates.

The results of evaluation of performance of the obtained reference absorbent composite (1) are shown in Table 1.

REFERENCE 2

A reference absorbent composite (2) was obtained in the same manner as in Embodiment 4, except that the monomer was polymerized for 20 minutes by putting the nonwoven fabric on a steel plate heated to 80° C. in a nitrogen atmosphere, instead of polymerizing by placing the nonwoven fabric applied with aqueous monomer solution between two steel press plates.

The results of evaluation of performance of the obtained reference absorbent composite (2) are shown in Table 1.

REFERENCE 3

A reference absorbent composite (3) was obtained in the same manner as in Embodiment 6, except that the monomer was polymerized for 20 minutes by putting the nonwoven fabric on a steel plate heated to 80° C. in a nitrogen atmosphere, instead of polymerizing by placing the nonwoven fabric applied with aqueous monomer solution between two steel press plates.

The results of evaluation of performance of the obtained reference absorbent composite (3) are shown in Table 1.

TABLE 1

| | Obtained absorbent composite | Ratio of absorption (g/g) | Amount of residual monomer (ppm) | Drop-off rate (%) |
|---|---|---|---|---|
| Embodiment 1 | Absorbent composite (1) | 42 | 120 | 2 |
| Embodiment 2 | Absorbent composite (2) | 43 | 100 | 2 |
| Embodiment 3 | Absorbent composite (3) | 48 | 150 | 6 |
| Embodiment 4 | Absorbent composite (4) | 38 | 80 | 1 |
| Embodiment 5 | Absorbent composite (5) | 40 | 60 | 4 |
| Embodiment 6 | Absorbent composite (6) | 32 | 200 | 3 |
| Embodiment 7 | Absorbent composite (7) | 34 | 150 | 4 |
| Reference 1 | Reference absorbent composite (1) | 36 | 9800 | 2 |
| Reference 2 | Reference absorbent composite (2) | 30 | 6400 | 1 |
| Reference 3 | Reference absorbent composite (3) | 29 | 9000 | 3 |

Hereinafter are shown the embodiments and references of the continuous manufacturing method of the present invention.

EMBODIMENT 8

To 100 parts by weight of partially neutralized acrylic acid aqueous solution (monomer concentration 60 wt. %) with 75 mol % neutralized by potassium hydroxide, 0.2 part by weight of potassium persulfate, and 0.005 part by weight of N,N'-methylene bisacrylamide were dissolved, and the dissolved oxygen in the aqueous monomer solution was removed by nitrogen gas.

Using the apparatus shown in FIG. 1, in this aqueous monomer solution, a polyethylene nonwoven fabric having 30 g/m$^2$ of basis weight was immersed, and the nonwoven fabric entirely impregnated with aqueous monomer solution was squeezed to set the deposition of aqueous monomer solution to 400 g/m$^2$.

In succession, the nonwoven fabric applied with aqueous monomer solution was moved while being, on both the sides, held in contact with a pair of facing fluororesin-treated endless steel belts shown in FIG. 1. The clearance C of the belt surfaces was set so as to be equal to the thickness of the nonwoven fabric in a stationary state by means of a clearance adjuster shown in FIG. 2. The holding time for pinching with the belt surfaces was 3 minutes, and the polymerization was conducted continuously in this period by maintaining the belt surface temperature at 80° C. in a nitrogen atmosphere. The moving speed of the nonwoven fabric was 1m per minute.

Sequentially, the nonwoven fabric after polymerization was led into a hot air dryer as shown in FIG. 1 to be dried continuously at 120° C., and an absorbent composite (8) was obtained. The holding time in the dryer was 3 minutes.

The results of evaluation of performance of the obtained absorbent composite (8) are shown in Table 2.

EMBODIMENT 9

In the apparatus shown in FIG. 1, as the equipment for applying aqueous monomer solution to the substrate, a gravure printing press was installed instead of the immersion tank of aqueous monomer solution, and glass fiber endless belts and a microwave generator with an output of 400 W for generating microwaves at frequency of 2,450 MHz were installed instead of the endless steel belts and steam heaters in the polymerization region.

Using such manufacturing apparatus for absorbent composite, the same aqueous monomer solution as used in Embodiment 8 was gravure-printed in dot pattern on a hydrophilic pulp mat having 45 g/m$^2$ of basis weight at the deposition of 400 g/m$^2$.

This pulp mat applied with aqueous monomer solution was moved while being held between a pair of facing fluororesin-treated glass fiber endless belt surfaces. The clearance C of the belt surfaces was set so as to be equal to the thickness of the pulp mat in a stationary state by means of a clearance adjuster shown in FIG. 2. Polymerization was continuously conducted by emitting microwaves with output of 400 W at frequency of 2,450 MHz to the pulp mat held between the belt surfaces. The ambient temperature during polymerization was 25° C., and the holding time between the belt surfaces was 30 seconds. The moving speed of the pulp mat was 1m per minute.

Sequentially, the pulp mat after polymerization was led into a hot air dryer and was continuously dried at 120° C., and an absorbent composite (9) was obtained. The holding time in the dryer was 3 minutes.

The results of evaluation of performance of the obtained absorbent composite (9) are shown in Table 2.

EMBODIMENT 10

To 100 parts by weight of partially neutralized acrylic acid aqueous solution (monomer concentration 40 wt. %) with 75 mol % neutralized by sodium hydroxide, 0.2 part by weight of 2,2'-azobis(N,N'-dimethyleneisobutylamidine)dihydrochloride and 0.005 part by weight of N,N'-methylene bisacrylamide were dissolved, and the dissolved oxygen in aqueous monomer solution was removed by nitrogen gas.

Using the apparatus shown in FIG. 3, the aqueous monomer solution was sprayed from spray nozzle to the polypropylene nonwoven fabric having 30 g/m$^2$ of basis weight so that the deposition may be 250 g/m$^2$.

In succession, the nonwoven fabric applied with aqueous monomer solution was moved while being held between the heat drum roll and the fluororesin-treated glass fiber endless belt surface covering the semicircumference of the drum roll surface shown in FIG. 3. The drum roll peripheral surface and belt surface were set to a clearance equal to the thickness of the nonwoven fabric in a stationary state by means of a clearance adjuster and the holding time of the nonwoven fabric between them was 3 minutes, and in this period polymerization was conducted continuously by maintaining the drum roll temperature at 60° C. in a nitrogen atmosphere. The nonwoven fabric moving speed was 0.3m per minute.

Sequentially, the nonwoven fabric after polymerization was led to beneath an infrared lamp shown in FIG. 3, and infrared rays were emitted to dry continuously, and an absorbent composite (10) was obtained. The output of the infrared lamp was 400 W, and the irradiation time was 3 minutes.

The results of evaluation of performance of the obtained absorbent composite (10) are shown in Table 2.

EMBODIMENT 11

An absorbent composite (11) was obtained in the same manner as in Embodiment 10, except that a polyester nonwoven fabric having 45 g/m$^2$ of basis weight was used instead of the polypropylene nonwoven fabric.

The results of evaluation of performance of the obtained absorbent composite (11) are shown in Table 2.

EMBODIMENT 12

An absorbent composite (12) was obtained in the same manner as in Embodiment 8, using the same aqueous monomer solution as used in Embodiment 10, except that the deposition of the aqueous monomer solution to the polyethylene nonwoven fabric was adjusted to 300 g/m$^2$.

The results of evaluation of performance of the obtained absorbent composite (12) are shown in Table 2.

EMBODIMENT 13

To 100 parts by weight of 50 wt. % aqueous monomer solution comprising 20 mol % of acrylic acid, 60 mol % of potassium acrylate and 20 mol % of 2-methacryloylethane sulfonic acid potassium salt, 0.5 part by weight of potassium persulfate, 0.003 part by weight of ethylene glycol diacrylate, and 0.1 part by weight of hydroxyethyl cellulose were dissolved, and the dissolved oxygen in the aqueous monomer solution was removed by nitrogen gas.

Using the apparatus shown in FIG. 1, in this aqueous monomer solution, a polypropylene nonwoven fabric having 30 g/m$^2$ of basis weight was immersed, and the nonwoven fabric entirely impregnated with the aqueous monomer solution was squeezed to adjust the deposition of the aqueous monomer solution to 150 g/m$^2$.

In succession, the nonwoven fabric applied with aqueous monomer solution was moved while being held between a pair of facing fluororesin-treated endless steel belt surfaces shown in FIG. 1. The clearance C of the belt surfaces was set so as to be equal to the thickness of the nonwoven fabric in a stationary state by means of a clearance adjuster shown in FIG. 2. The holding time between the belt surfaces was 3 minutes, and in this period polymerization was conducted continuously by keeping the belt surface temperature at 80° C. in a nitrogen atmosphere. The nonwoven fabric moving speed was 1m per minutes.

Sequentially, the nonwoven fabric after polymerization was led into a drying chamber furnished with a microwave generator with an output of 600 W for generating microwaves at frequency of 2,450 MHz, instead of the hot air dryer in FIG. 1, and it was continuously dried, and an absorbent composite (13) was obtained. The holding time in the drying chamber was 30 seconds.

The results of evaluation of performance of the obtained absorbent composite (13) are shown in Table 2.

EMBODIMENT 14

To 100 parts by weight of 40 wt. % aqueous monomer solution comprising 15 mol % of methacrylic acid, 45 mol % of sodium methacrylate, 20 mol % of 2-acrylamide-2-methylpropane sulfonic acid sodium salt, and 20 mol % of acrylamide, 0.2 part by weight of ammonium persulfate and 0.005 part by weight of trimethylol propane triacylate were dissolved, and the dissolved oxygen in the aqueous monomer solution was removed by nitrogen gas.

Using the apparatus shown in FIG. 3, the aqueous monomer solution was sprayed from a spray nozzle to a nonwoven fabric consisting of a conjugated polyethylene-propylene fiber and having 40 g/m$^2$ of basis weight to the deposition of 200 g/m$^2$.

In succession, the nonwoven fabric applied with the aqueous monomer solution was moved as being held between a drum roll and a fluororesin-treated glass fiber endless belt surface covering the semicircumference of the drum roll shown in FIG. 3. The drum roll peripheral surface and belt surface were set to a clearance equal to the thickness of the nonwoven fabric in a stationary state by means of a clearance adjuster and the holding time of the nonwoven fabric between them was 3 minutes, and in this period polymerization was conducted continuously while maintaining the drum roll temperature at 80° C. in a nitrogen atmosphere. The moving speed of the nonwoven fabric was 0.3m per minute.

Sequentially, the nonwoven fabric after polymerization was led into a hot air dryer, instead of the drying chamber with an infrared ray lamp in FIG. 3, and was continuously dried at 120° C., and an absorbent composite (14) was obtained. The holding time in the dryer was 3 minutes.

The results of evaluation of performance of the obtained absorbent composite (14) are shown in Table 2.

REFERENCE 4

The following operation was performed in the same manner as in Embodiment 8, by using the same apparatus as shown in FIG. 1 except that the upper endless belt 1A was removed.

After immersing a polyethylene nonwoven fabric having 30 g/m$^2$ of basis weight in the same aqueous monomer solution as that used in Embodiment 8, the nonwoven fabric entirely impregnated with aqueous monomer solution was squeezed to adjust the deposition of the aqueous monomer solution to 400 g/m$^2$.

In succession, the nonwoven fabric applied with aqueous monomer solution was moved by putting on a fluororesin-treated endless steel belt 1B. The holding time on the belt was 20 minutes, and in this period polymerization was conducted continuously by maintaining the belt surface at 80° C. in a nitrogen atmosphere. The moving speed of the nonwoven fabric was 0.15 m per minute.

Sequentially, the nonwoven fabric after polymerization was led into a hot air dryer and was dried continuously at 120° C., and a reference absorbent composite (4) was obtained. The holding time in the dryer was 5 minutes.

The results of evaluation of performance of the obtained reference absorbent composite (4) are shown in Table 2.

REFERENCE 5

The following operation was performed in the same manner as in Embodiment 14, using the same apparatus as shown in FIG. 3, except that the endless belt 14 covering the drum roll 13 was removed and that a hot air dryer was installed instead of the infrared ray lamp.

The same aqueous monomer solution as used in Embodiment 14 was sprayed from a spray nozzle to a nonwoven fabric consisting of a conjugated polyethylene-propylene fiber and having 40 g/m$^2$ of basis weight to the deposition of 200 g/m$^2$.

In succession, the nonwoven fabric applied with aqueous monomer solution was moved along the periphery of the drum roll 13. The holding time of the nonwoven fabric in contact with the drum roll periphery was 20 minutes, and in this period polymerization was conducted continuously by maintaining the drum roll temperature at 80° C. in a nitrogen atmosphere. The moving speed of the nonwoven fabric was 0.045m per minute.

Sequentially, the nonwoven fabric after polymerization was led into a hot air dryer, and was continuously dried at 120° C., and a reference absorbent composite (5) was obtained. The holding time in the dryer was 5 minutes.

The results of evaluation of performance of the obtained reference absorbent composite (5) are shown in Table 2.

EMBODIMENT 15

A gravure printing press was installed instead of the immersion tank of aqueous monomer solution as the apparatus for applying the aqueous monomer solution of the substrate in the apparatus shown in FIG. 1.

Using such an apparatus, the same aqueous monomer solution as used in Embodiment 8 was gravure-printed in dot pattern on the rayon nonwoven fabric having 80 g/m$^2$ of basis weight to the deposition of 400 g/m$^2$.

The nonwoven fabric applied with aqueous monomer solution was moved as being held between a pair of facing fluororesin-treated endless steel belt surfaces. The clearance C of the belt surfaces was set so as to be equal to the thickness of the nonwoven fabric in a stationary state by means of a clearance adjuster shown in FIG. 2. The holding time between the belt surfaces was 2 minutes, and in this period polymerization was conducted continuously while maintaining the belt surface temperature at 120° C. in a nitrogen atmosphere, and an absorbent composite (15) was obtained. The moving speed of the nonwoven fabric was 25m per minute.

The results of evaluation of performance of the obtained absorbent composite (15) are shown in Table 2.

EMBODIMENT 16

To 100 parts by weight of partially neutralized acrylic acid aqueous solution (monomer concentration 37 wt. %) with 75 mol % neutralized by sodium hydroxide, 0.2 part by weight of sodium persulfate and 0.05 part by weight of N,N'-methylene bisacrylamide were dissolved, and the dissolved oxygen in the aqueous monomer solution was removed by nitrogen gas.

Using the apparatus shown in FIG. 1, a polyester nonwoven fabric having 30 g/m$^2$ of basis weight was immersed in this aqueous monomer solution, and the nonwoven fabric entirely impregnated with aqueous monomer solution was squeezed to adjust the deposition of the aqueous monomer solution to 80 g/m$^2$.

In succession, the nonwoven fabric applied with aqueous monomer solution was moved as being held between a pair of facing fluororesin-treated glass fiber endless belt surfaces shown in FIG. 1. The clearance C of the belt surfaces was set so as to be equal to the thickness of the nonwoven fabric in a stationary state by means of a clearance adjuster shown in FIG. 2. The holding time between the belt surfaces was 3 minutes, and in this period polymerization was conducted continuously while maintaining the belt surface temperature at 100° C. in a nitrogen atmosphere. The moving speed of the nonwoven fabric was 1m per minute.

Sequentially, the nonwoven fabric after polymerization was led into a hot air dryer shown in FIG. 1, and was dried continuously at 120° C., and an absorbent composite (16) was obtained. The holding time in the dryer was 3 minutes.

The results of evaluation of performance of the obtained absorbent composite (16) are shown in Table 2.

EMBODIMENT 17

An absorbent composite (17) was obtained by polymerizing in the same manner as in Embodiment 16, except that 0.1 part by weight of trimethylol propane triacylate was used instead of N,N'-methylene bisacrylamide, by depositing the aqueous monomer solution by 25 g/m$^2$ and maintaining the temperature of glass fiber endless belts at 120° C.

The results of evaluation of performance of the obtained absorbent composite (17) are shown in Table 2.

EMBODIMENT 18

To 100 parts by weight of partially neutralized acrylic acid aqueous solution (monomer concentration 35 wt. %) with 75 mol % neutralized by sodium hydroxide, 0.4 part by weight of 2,2'-azobis(2-amidinopropane)dihydrochloride and 0.2 part by weight of polyethylene glycol diacrylate (mean oxyethylene units: 8) were dissolved, and the dissolved oxygen in aqueous monomer solution was removed by nitrogen gas.

Using the apparatus shown in FIG. 1, a polyester nonwoven fabric having 30 g/m$^2$ of basis weight was immersed in this aqueous monomer solution, and the nonwoven fabric entirely impregnated with aqueous monomer solution was squeezed, and the deposition of aqueous monomer solution was adjusted to 300 g/m$^2$.

In succession, the nonwoven fabric applied with aqueous monomer solution was moved while being held between a pair of facing fluororesin-treated endless steel belt surfaces shown in FIG. 1. The clearance C of the belt surfaces was set so as to be equal to the thickness of the nonwoven fabric in a stationary state by means of a clearance adjuster shown in FIG. 2. The holding time between the belt surfaces was 3 minutes, and in this period polymerization was conducted continuously while keeping the belt surface temperature at 120° C. in a nitrogen atmosphere. The moving speed of the nonwoven fabric was 10m per minute.

Sequentially, the nonwoven fabric after polymerization was led into a hot air dryer shown in FIG. 1, and was dried continuously at 120° C., and an absorbent composite (18) was obtained. The holding time in the dryer was 3 minutes.

The results of evaluation of performance of the obtained absorbent composite (18) are shown in Table 2.

EMBODIMENT 19

To 100 parts by weight of partially neutralized acrylic acid aqueous solution (monomer concentration 60 wt. %) with 60 mol % neutralized by potassium hydroxide, 0.6 part by weight of 2,2'-azobis(2-amidinopropane) dihydrochloride and 0.09 part by weight of N,N'-methylene bisacrylamide were dissolved, and the dissolved oxygen in the aqueous monomer solution was removed by nitrogen gas.

Using the apparatus shown in FIG. 1, a polyester nonwoven fabric having 30 g/m$^2$ of basis weight was immersed in this aqueous monomer solution, and the nonwoven fabric entirely impregnated with aqueous monomer solution was squeezed, and the deposition of aqueous monomer solution was adjusted to 400 g/m$^2$.

In succession, the nonwoven fabric applied with aqueous monomer solution was moved while being held between a pair of facing fluororesin-treated endless steel belt surfaces shown in FIG. 1. The clearance C of the belt surfaces was set so as to be equal to the thickness of the nonwoven fabric in a stationary state by means of a clearance adjuster shown in FIG. 2. The holding time between the belt surfaces was 3 minutes, and in this period polymerization was conducted continuously while keeping the belt surface temperature at 120° C. in a nitrogen atmosphere. The moving speed of the nonwoven fabric was 1m per minute.

Sequentially, the nonwoven fabric after polymerization was led into a hot air dryer shown in FIG. 1, and was dried continuously at 120° C., and an absorbent composite (19) was obtained. The holding time in the dryer was 3 minutes.

The results of evaluation of performance of the obtained absorbent composite (19) are shown in Table 2.

EMBODIMENT 20

To 100 parts by weight of 40 wt. % aqueous monomer solution comprising 20 mol % of acrylic acid, 60 mol % of sodium acrylate and 20 mol % of ammonium acrylate, 0.2 part by weight of sodium persulfate and 1.5 parts by weight of N,N'-methylene bisacrylamide were dissolved, and the dissolved oxygen in the aqueous monomer solution was removed by nitrogen gas.

Using the apparatus shown in FIG. 1, a polyester nonwoven fabric having 30 g/m$^2$ of basis weight was immersed in this aqueous monomer solution, and the nonwoven fabric entirely impregnated with aqueous monomer solution was squeezed, and the deposition of aqueous monomer solution was adjusted to 250 g/m$^2$.

In succession, the nonwoven fabric applied with aqueous monomer solution was moved while being held between a pair of facing fluororesin-treated endless steel belt surfaces shown in FIG. 1. The clearance C of the belt surfaces was set so as to be equal to the thickness of the nonwoven fabric in a stationary state by means of a clearance adjuster shown in FIG. 2. The holding time between the belt surfaces was 3 minutes, and in this period polymerization was conducted continuously while keeping the belt surface temperature at 110° C. in a nitrogen atmosphere. The moving speed of the nonwoven fabric was 10m per minute.

Sequentially, the nonwoven fabric after polymerization was led into a hot air dryer shown in FIG. 1, and was dried continuously at 120° C., and an absorbent composite (20) was obtained. The holding time in the dryer was 3 minutes.

The results of evaluation of performance of the obtained absorbent composite (20) are shown in Table 2.

EMBODIMENT 21

To 100 parts by weight of partially neutralized acrylic acid aqueous solution (monomer concentration 40 wt. %) with 60 mol % neutralized by sodium hydroxide, 0.2 part by weight of sodium persulfate and 0.05 part by weight of ethyleneglycol diglycidylether were dissolved, and the dissolved oxygen in the aqueous monomer solution was removed by nitrogen gas.

Using the apparatus shown in FIG. 1, a polyester nonwoven fabric having 60 g/m$^2$ of basis weight was immersed in this aqueous monomer solution, and the nonwoven fabric entirely impregnated with aqueous monomer solution was squeezed, and the deposition of aqueous monomer solution was adjusted to 400 g/m$^2$.

In succession, the nonwoven fabric applied with aqueous monomer solution was moved while being held between a pair of facing fluororesin-treated endless steel belt surfaces shown in FIG. 1. The clearance C of the belt surfaces was set so as to be equal to the thickness of the nonwoven fabric in a stationary state by means of a clearance adjuster shown in FIG. 2. The holding time between the belt surfaces was 1 minutes, and in this period polymerization was conducted continuously while keeping the belt surface temperature at 150° C. in a nitrogen atmosphere. The moving speed of the nonwoven fabric was 50m per minute.

Sequentially, the nonwoven fabric after polymerization was led into a hot air dryer shown in FIG. 1, and was dried continuously at 120° C., and an absorbent composite (21) was obtained. The holding time in the dryer was 3 minutes.

The results of evaluation of performance of the obtained absorbent composite (21) are shown in Table 2.

EMBODIMENT 22

To 100 parts by weight of partially neutralized acrylic acid aqueous solution (monomer concentration 40 wt. %) with 85 mol % neutralized by sodium hydroxide, 0.05 part by weight of N,N'-methylene bisacrylamide, 0.2 part by weight of sodium persulfate, and 0.2 part by weight of hydrogen peroxide were dissolved, and 10 parts by weight of hydrophilic pulp fibers with fiber length of 50 μm were added, and the dissolved oxygen in the aqueous monomer solution was removed by nitrogen gas.

Using the apparatus shown in FIG. 1, a polyester nonwoven fabric having 30 g/m$^2$ of basis weight was immersed in this aqueous monomer solution, and the nonwoven fabric entirely impregnated with aqueous monomer solution was squeezed, and the deposition of aqueous monomer solution was adjusted to 300 g/m$^2$.

In succession, the nonwoven fabric applied with aqueous monomer solution was moved while being held between a pair of facing fluororesin-treated endless steel belt surfaces shown in FIG. 1. The clearance C of the belt surfaces was set so as to be equal to the thickness of the nonwoven fabric in a stationary state by means of a clearance adjuster shown in FIG. 2. The holding time between the belt surfaces was 3 minutes, and in this period polymerization was conducted continuously while keeping the belt surface temperature at 120° C. in a nitrogen atmosphere. The moving speed of the nonwoven fabric was 10m per minute.

Sequentially, the nonwoven fabric after polymerization was led into a hot air dryer shown in FIG. 1, and was dried continuously at 120° C., and an absorbent composite (22) was obtained. The holding time in the dryer was 3 minutes.

The results of evaluation of performance of the obtained absorbent composite (22) are shown in Table 2.

EMBODIMENT 23

To 100 parts by weight of aqueous monomer solution (monomer concentration 50 wt. %) comprising 20 mol % of acrylic acid, 65 mol % of sodium acrylate, and 15 mol % of methoxy polyethylene glycol acrylate (mean oxyethylene units: 10), 0.35 part by weight of sodium persulfate and 0.05 part by weight of N,N'-methylene bisacrylamide were dissolved, and the dissolved oxygen in the aqueous monomer solution was removed by nitrogen gas.

Using the apparatus shown in FIG. 1, a polyester nonwoven fabric having 30 g/m$^2$ of basis weight was immersed in this aqueous monomer solution, and the nonwoven fabric entirely impregnated with aqueous monomer solution was squeezed, and the deposition of aqueous monomer solution was adjusted to 200 g/m$^2$.

In succession, the nonwoven fabric applied with aqueous monomer solution was moved while being held between a pair of facing fluororesin-treated endless steel belt surfaces shown in FIG. 1. The clearance C of the belt surfaces was set so as to be equal to the thickness of the nonwoven fabric in a stationary state by means of a clearance adjuster shown in FIG. 2. The holding time between the belt surfaces was 5 minutes, and in this period polymerization was conducted continuously while keeping the belt surface temperature at 100° C. in a nitrogen atmosphere. The moving speed of the nonwoven fabric was 0.5m per minute.

Sequentially, instead of leading the nonwoven fabric after polymerization into the hot air dryer shown in FIG. 1, it was led into a drying chamber equipped with a 3 kW high pressure mercury vapor lamp, and it was dried continuously as being irradiated with ultraviolet rays, and absorbent composite (23) was obtained. The clearance between the nonwoven fabric and mercury vapor lamp was 10 cm, and the holding time was 15 seconds.

The results of evaluation of performance of the obtained absorbent composite (23) are shown in Table 2.

EMBODIMENT 24

An absorbent composite (24) was obtained by drying the nonwoven fabric after polymerization in Embodiment 16 by irradiating with ultraviolet rays in the same manner as in Embodiment 23.

The results of evaluation of performance of the obtained absorbent composite (24) are shown in Table 2.

EMBODIMENT 25

An absorbent composite (25) was obtained in the same manner in Embodiment 16, except that the deposition of the aqueous monomer solution was adjusted to 200 g/m$^2$, and that the polymerization was performed by maintaining the belt surface temperature at 120° C.

The results of evaluation of performance of the obtained absorbent composite (25) are shown in Table 2.

REFERENCE 6

A reference absorbent composite (6) was obtained by polymerizing the monomer fixed to the nonwoven fabric in a nitrogen atmosphere while maintaining the belt surface temperature at 120° C., by removing the upper belt 1A in Embodiment 15. The holding time on the belt was 5 minutes, and the moving speed of the nonwoven fabric was 10m per minute.

The results of evaluation of performance of the obtained reference absorbent composite (6) are shown in Table 2.

REFERENCE 7

A reference absorbent composite (7) was obtained by polymerizing the monomer fixed to the nonwoven fabric in a nitrogen atmosphere while maintaining the belt surface temperature at 100° C., by removing the upper belt 1A in Embodiment 16, and drying in a hot air dryer at 120° C. The holding time on the belt and in the dryer was both 5 minutes, and the moving speed of the nonwoven fabric was 0.6m per minute.

The results of evaluation of performance of the obtained reference absorbent composite (7) are shown in Table 2.

REFERENCE 8

A reference absorbent composite (8) was obtained by polymerizing the monomer fixed to the nonwoven fabric in a nitrogen atmosphere while maintaining the belt surface temperature at 150° C., by removing the upper belt 1A in Embodiment 21. The holding time on the belt was 2 minutes, and the moving speed of the nonwoven fabric was 25m per minute.

The results of evaluation of performance of the obtained reference absorbent composite (8) are shown in Table 2.

TABLE 2

| | Obtained absorbent composite | Ratio of absorption (g/g) | Amount of residual monomer (ppm) | Drop-off rate (%) |
|---|---|---|---|---|
| Embodiment 8 | Absorbent composite (8) | 37 | 90 | 2 |
| Embodiment 9 | Absorbent composite (9) | 40 | 60 | 3 |
| Embodiment 10 | Absorbent composite (10) | 43 | 110 | 7 |
| Embodiment 11 | Absorbent composite (11) | 43 | 100 | 6 |
| Embodiment 12 | Absorbent composite (12) | 49 | 140 | 4 |
| Embodiment 13 | Absorbent composite (13) | 33 | 210 | 3 |
| Embodiment 14 | Absorbent composite (14) | 35 | 150 | 4 |
| Embodiment 15 | Absorbent composite (15) | 38 | 60 | 4 |
| Embodiment 16 | Absorbent composite (16) | 25 | 140 | 1 |
| Embodiment 17 | Absorbent composite (17) | 28 | 100 | 1 |
| Embodiment 18 | Absorbent composite (18) | 32 | 80 | 1 |
| Embodiment 19 | Absorbent composite (19) | 26 | 180 | 2 |
| Embodiment 20 | Absorbent composite (20) | 15 | 80 | 3 |
| Embodiment 21 | Absorbent composite (21) | 28 | 110 | 2 |
| Embodiment 22 | Absorbent composite (22) | 24 | 140 | 3 |
| Embodiment 23 | Absorbent composite (23) | 20 | 280 | 4 |
| Embodiment 24 | Absorbent composite (24) | 24 | 180 | 1 |
| Embodiment 25 | Absorbent composite (25) | 26 | 90 | 2 |
| Reference 4 | Reference absorbent composite (4) | 29 | 7200 | 2 |
| Reference 5 | Reference absorbent composite (5) | 26 | 9500 | 8 |
| Reference 6 | Reference absorbent composite (6) | 32 | 8000 | 5 |
| Reference 7 | Reference absorbent composite (7) | 24 | 5500 | 1 |
| Reference 8 | Reference absorbent composite (8) | 22 | 6800 | 4 |

What is claimed is:

1. A method of manufacturing a water absorbent composite comprising applying to a substrate an aqueous solution containing a water-soluble radical polymerization initiator and a water-soluble ethylenically unsaturated monomer which can be converted into a water absorbent polymer by polymerization, and polymerizing said monomer under a condition that two sides of the substrate applied with said aqueous solution are held in contact against polymerization-inert surfaces which face each other.

2. A method of manufacturing a water absorbent composite according to claim 1, wherein the substrate to which the formed absorbent polymer is fixed after polymerization of said monomer is dried in a gas.

3. The process of claim 1 wherein said polymerization-inert surfaces are surfaces that are impermeable to oxygen, and which are composed of at least one member selected from the group consisting of glass fiber, fluororesin, silicone resin, steel and polyester resin.

4. A method of continuously manufacturing a water absorbent composite comprising continuously passing a substrate through an application region and a polymerization region, applying to the substrate in said application region an aqueous solution containing a water-soluble radical polymerization initiator and a water-soluble ethylenically unsaturated monomer which can be converted into a water-absorbent polymer by polymerization, and polymerizing the monomer in said polymerization region under a condition that two sides of the substrate are held in contact with polymerization-inert surfaces which face each other.

5. A method of continuously manufacturing a water absorbent composite according to claim 4, further comprising passing the substrate through a drying region for heating the substrate, after said polymerization region, while keeping the substrate in a gas atmosphere.

6. A method of continuously manufacturing a water absorbent composite, comprising passing a substrate applied with an aqueous solution containing a water-soluble radical polymerization initiator and a water-soluble ethylenically unsaturated monomer which can be converted into a water absorbent polymer by polymerization through a polymerization region and a drying region;

polymerizing the monomer in said polymerization region, while contacting both sides of said substrate with polymerization-inert surfaces which face each other, and in said drying region, heating the substrate while keeping in a gas atmosphere.

7. A continuous manufacturing method according to claim 5 or 6, wherein the drying region is adapted to apply heat to said substrate by means of hot gas, microwaves, infrared rays or ultraviolet rays, while holding the substrate in a gas atmosphere by means of rotatable support roll and/or support belt.

8. A manufacturing method according to claims 6, wherein said water-soluble ethylenically unsaturated monomer is mainly composed of (meth)acrylic acid or its salt.

9. A manufacturing method according to claim 8, wherein said polymerization is effected by heating said substrate.

10. A manufacturing method according to claim 9, wherein said heating is conducted in a temperature range of 50° to 150° C.

11. A manufacturing method according to claim 9, wherein said heating is effected by microwaves.

12. A manufacturing method according to claim 11, wherein said substrate is a fibrous substrate.

13. A manufacturing method according to claim 12, wherein said aqueous solution contains a water-soluble crosslinking agent.

14. A manufacturing method according to claim 13, wherein said polymerization-inert surfaces are fluorocarbonresin-treated or mirror-finished surfaces.

* * * * *